US005738250A

United States Patent [19]

Gillingham et al.

[11] Patent Number: 5,738,250

[45] Date of Patent: Apr. 14, 1998

[54] LIQUID DISPENSING PUMP HAVING WATER SEAL

[75] Inventors: James R. Gillingham, Hacienda Heights; Tanny Li, Walnut; Kenneth D. Siegel, Redondo Beach, all of Calif.

[73] Assignee: Calmar Inc., City of Industry, Calif.

[21] Appl. No.: 826,702

[22] Filed: Apr. 7, 1997

[51] Int. Cl.[6] ..... B67D 5/42

[52] U.S. Cl. ..... 222/153.13; 222/321.9

[58] Field of Search ..... 222/153.13, 321.1, 222/321.7, 321.9, 382, 383.1, 383.3, 385; 239/333

[56] References Cited

U.S. PATENT DOCUMENTS 3,062,416 11/1962 Cooprider ..... 222/153.13
3,179,306 4/1965 Corsette ..... 222/153.13 X
3,282,472 11/1966 Roder ..... 222/321.9
3,391,647 7/1968 Corsette et al. .
4,344,744 8/1982 Schuster et al. ..... 222/321.9 X
4,728,008 3/1988 Graf et al. .
5,401,148 3/1995 Foster et al. ..... 222/153.13 X

*Primary Examiner*—Kenneth Bomberg
*Attorney, Agent, or Firm*—Watson Cole Stevens DAvis, P.L.L.C.

[57] ABSTRACT

A manually actuated pump dispenser has a water seal for maintaining the container vent ports sealed closed during pumping until at or near the end of the pressure stroke whereupon a vent path through which only air is permitted travel into the container, is open as the path is shielded against water entering the vent path when pumping in a wet environment as when dispensing hair shampoo or hair conditioner. In a plunger lock-down position of shipping and storage, leakage of product through the vent ports is substantially avoided during a superatmospheric condition within the container.

10 Claims, 2 Drawing Sheets

LIQUID DISPENSING PUMP HAVING WATER SEAL

BACKGROUND OF THE INVENTION

This invention relates to a manually actuated liquid dispensing pump capable of being operated in a wet environment without the ingress of water through the open container vent port into the container in any condition of the pump plunger, even during pumping. Moreover, the vent port is sealed closed in a plunger lock-down condition of shipping and storage to seal against leakage of product from the container outwardly through the vent port during a condition of superatmospheric pressure within the container.

As well known, manually actuated liquid pump dispensers must have a vent port or ports to facilitate the replacement of product dispensed from the container with air to avoid container collapse (sometimes referred to as panelling) and hydraulic lock of the piston. The vent port is sealed closed during an at rest condition of the dispenser as at the end of the plunger upstroke. Therefore, should the dispenser be tilted or inverted, the product will not leak out through the vent port.

The vent port of some dispensers are likewise sealed closed in a plunger lock-down condition of shipping and storage.

However, the known manually actuated pump dispensers, when used in a wet environment such as when taking a shower, have a tendency to admit water through the open vent port when pumping such that the product, which may be body wash soap, hair shampoo or hair conditioner, is undesirably diluted within the container. Water enters the container through the open vent port by the same vent passage opened to admit air during pumping.

For example, the liquid dispensing pump disclosed in U.S. Pat. No. 3,391,647 has, in the uppermost position of the piston, a container vent seal on a collar in sealing engagement with a circular edge on the piston stem to seal the vent ports closed. During pumping the collar seal disengages from the circular edge to thereby open the vent.

The dispenser disclosed in U.S. Pat No. 4,728,008 has a vent seal, on the upper end wall of the container to which the pump is affixed, in engagement with an inner sleeve of the plunger head for sealing the interior of the container closed during the at rest position of the piston. Upon a slight depression of the piston head, the seal engages a longitudinal groove on the inner sleeve for ventilating the interior of the container. This dispenser is intended to deliver or distribute flowable media, particularly pastes or the like.

The '647 dispenser, however, has its vent seal exposed directly to the atmosphere such that, at the start of pumping, water can enter the container interior through the open vent path. And, the interior of the container of the '008 dispenser is ventilated by opening a vent path through which water can enter if the dispenser were to be used in a wet environment, which is unlikely.

SUMMARY OF THE INVENTION

It is therefore an object of the present invention to provide a manually actuated liquid dispensing pump capable of being operated in a wet environment whereby any tendency for water to seep into the container during pumping, which would dilute the product, is substantially avoided. Another feature of the invention is to avoid the leakage of product out through the vent port because of a prevailing superatmospheric condition within the container during shipping and storage as when the plunger is in a lock-down position.

According to the invention, the pump dispenser has seal means in liquid tight sliding sealing engagement with the piston stem for sealing the vent port closed during pumping operation to avoid the ingress of liquid into the container via the vent port when using the pump in a wet environment. This sealing engagement is interrupted at or near the end of the piston downstroke for opening the vent port while still preventing the ingress of water into the container via the open vent port. Means on the stem, such as one or more longitudinal grooves or ribs, are maintained substantially moisture-free by a depending, spaced and overlying skirt on the plunger head such that the tendency for any water to seep into the container via the vent port in this unsealed and vent open condition is substantially avoided.

During pumping the depending skirt on the plunger extends at its free end into an open annular groove formed in a collar surrounding the seal means which groove will collect water. To avoid an entrainment of water in an annular chamber formed between the skirt and the stem, the skirt has one or more ports for venting that chamber.

The plunger head is capable of being locked down to the pump during shipping and storage using conventional lock-down means. In the lock-down condition, a shoulder on the seal means seals against a shoulder beneath the head, and the vent groove is spaced from the upper end of the stem to present a smooth stem surface for the seal means, such that leakage of product out through the vent port during conditions of superatmospheric pressure developing within the container, is avoided.

The water seal means may be in the form of a seal member having a central opening through which the piston stem extends, the seal member having an annular chevron seal in liquid tight sliding sealing engagement with the piston stem during pumping. The seal member is mounted at an upper open end of the pump cylinder by the collar or chaplet through which the piston stem extends, the collar or chaplet being affixed to an upstanding flange on the pump cylinder and overlying the container closure. The water seal outer flange creates a seal with the pump cylinder to avoid water ingression.

Other objects, advantages and novel features of the invention will become more apparent from the following detailed description of the invention when taken in conjunction with the accompanying drawings.

DETAILED DESCRIPTION OF THE INVENTION

Figure 1:
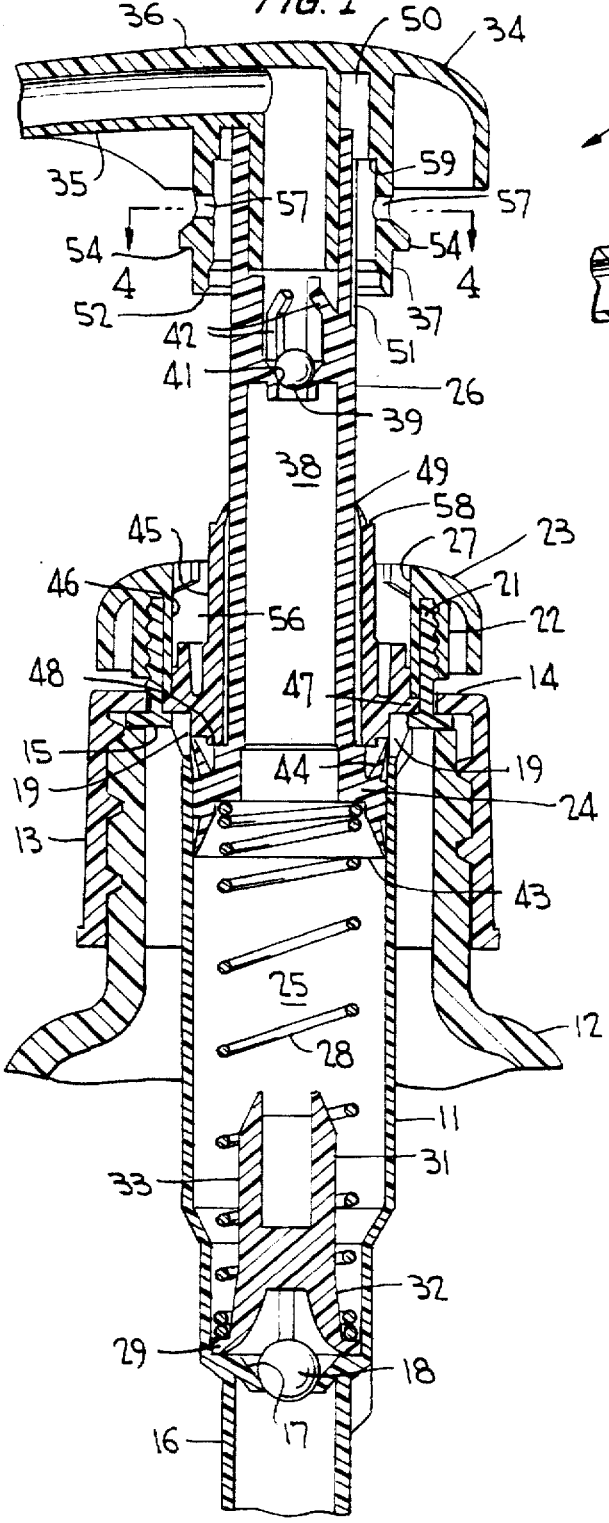
FIG. 1 is a vertical sectional view of the liquid dispensing pump of the invention having a water seal, the pump being shown in an at rest position.

Turning now to the drawings wherein like reference characters refer to like and corresponding parts throughout the several views, the pump dispenser according to the invention is generally designated 10 as having a pump body which includes a pump cylinder 11 extending into the interior of a container 12 partially shown in FIG. 1, the pump body being mounted to the container neck by a container closure 13 in the known manner as by an inner flange 14 of the closure overlying an outer flange 15 of the pump cylinder. A depending cylindrical sleeve 16 at the lower end of the pump body supports a dip tube (not shown) which extends into the container interior. An inlet valve seat 17 is defined between pump cylinder 11 and sleeve 16 for the reception of an inlet ball check valve 18.

One or more container vent ports 19 are provided in the wall of cylinder 11 at or near the upper end thereof, and an upstanding sleeve 21 of the pump cylinder is externally knurled to provide a tight friction fit with depending sleeve 22 of a collar or chaplet 23.

A pump piston 24 is mounted for reciprocation within cylinder 11 to therewith define a variable volume pump chamber 25, the piston having a hollow piston stem 26 extending through a central opening 27 of the collar. The piston is resiliently biased out of its bore by a piston return coil spring 28 extending between the underside of the piston and a flange 29 of a dispenser seal 31 having a plurality of spaced legs 32 defining a ball cage for the inlet ball check valve. The return spring retains the dispenser seal in place, the seal having an upstanding plug 33 adapted to project into and seal the lower end of the piston stem in the plunger lock-down position of FIG. 3.

A plunger head 34 is fixedly mounted to the upper end of the piston stem, the head having a discharge spout 35 or the like and an upper wall 36 defining a finger or hand rest against which downward finger or hand pressure is applied by the operator for actuating the pump.

The structure and arrangement of the present pump dispenser is of the type having a substantial portion of its piston stem exposed directly to the atmosphere, i.e., such substantial portion of the stem is not covered by any other structure of the pump. However, an upper portion of the stem is covered by a sleeve 37 depending from the plunger head, the sleeve overlying that upper portion in spaced relation, as shown.

The hollow stem defines a discharge passage 38 for liquid product flowing therethrough which is controlled by a discharge valve which may be in the form of a ball check valve 39 seated against its seat 41, a plurality of fingers 42 being molded or cold formed within the stem to define a ball cage for the discharge valve. The piston has a depending feathered piston seal 43, generally known as a chevron seal, in sliding sealing engagement with the wall of the pump cylinder. The piston may likewise be provided with an upstanding feathered seal 44 in sliding sealing engagement with the wall of the pump cylinder generally for avoiding blow-by of product around the piston during the piston suction strokes.

According to the invention, the dispenser has seal means which may be in the form of a separate seal member 45 having a central opening through which the piston stem extends, and being mounted in place over the upper end of the pump cylinder by collar 23. A depending inner flange 46 of the collar engages an external flange 47 of the seal member which sealingly engages upstanding flange 21 of the pump cylinder for sealing against ingress of water into the container via the container vent port in any condition of the plunger. An upper shoulder 48 of the piston bears against the lower edge of seal member 45 to define a limit stop for the piston.

The seal member has an upstanding annular feathered seal 49, known as a chevron seal, in fluid tight sliding sealing engagement with piston stem 26 during pumping. As will be explained in more detail hereinafter, the vent ports remain closed by the sealing action between seal 49 and the piston stem during plunger reciprocation while the stem slides relative to seal 49 through a predetermined length of travel. During this course of travel, any seepage or ingress of water, as when dispensing products such as body wash soap, hair shampoo or hair conditioner in the shower, into the interior of the container via the inlet ports is substantially avoided by the sliding sealing action afforded by seal 49.

Means are provided on the outer surface of the piston stem beneath depending sleeve 37 for interrupting the sealing action presented by seal 49 at or near the end of the piston compression stroke. Such means may be in the form of one or more longitudinal grooves 51, or equivalent longitudinal ribs (not shown), the grooves terminating at about lower edge 52 of sleeve 37.

Figure 2:
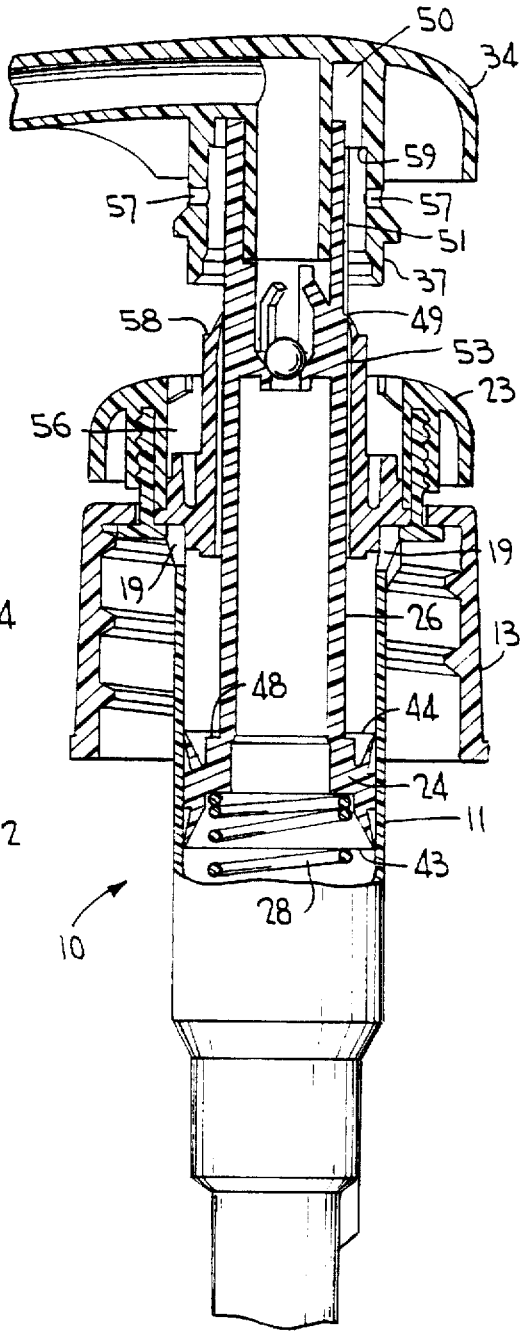
FIG. 2 is a view similar to FIG. 1 showing the pump in a plunger depressed position during pumping.

Starting at a position near the end of the piston pressure stroke, shown in FIG. 2, seal 49 engages the groove or grooves 51 so that the sealing action of seal 49 is interrupted and an air path is created through which air is permitted to enter the container via vent ports 19 and via annular gap 53 between the inner diameter of seal member 45 and the outer diameter of piston stem 26.

In the FIG. 2 position, with the container vent open, grooves 51 remain essentially moisture-free as they are shielded by skirt 37 as water from the shower head generally beats down from above against the plunger head. Thus, only air is admitted through the open vent path into the container to replace product as it is dispensed to thereby avoid container collapse and hydraulic lock. There is little, if any, tendency for water to flow through the open vent path in the FIG. 2 condition into the container when using the dispenser in a wet environment, because of the shielded action afforded by skirt 37.

Upon continued depression of the plunger beyond that shown in FIG. 2, the free end of skirt 37 extends into annular groove 56 formed between collar 23 and member 45. In a wet environment this groove will collect water such that the free end of skirt 37 is immersed in the collected water and tends to entrain water at the annular opening formed between the skirt free end and the stem, during the plunger return stroke to its FIG. 1 position. The entrainment of water, if allowed to persist, would permit ingress of water into the container during the vent open condition of FIG. 2.

Thus, according to the invention, the annular chamber 50 formed between skirt 37 and the stem is vented to atmosphere by the provision of ports 57 in skirt 37. It has been found that such venting avoids water entrainment at the free end of the skirt and thereby maintains the vent groove or grooves 51 substantially free of water and thus avoids seepage of water into the container through the open vent path.

As known in the art, the plunger and its piston return to the FIG. 1 position upon release of external pressure applied to the head. During this suction stroke, pump chamber 25 expands to thereby lower the pressure whereupon product from the container at atmospheric pressure flows into the pump chamber through the unseated inlet ball check valve 18.

Figure 3:
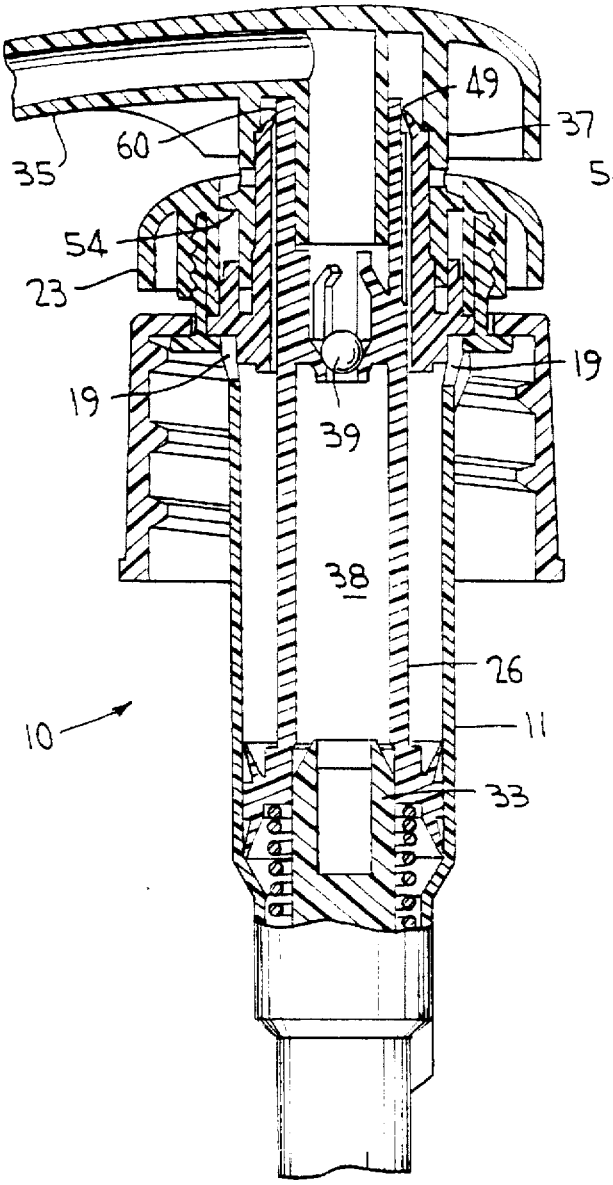
FIG. 3 is a view similar to FIG. 1 showing the plunger in its lock-down position.
Figure 4:
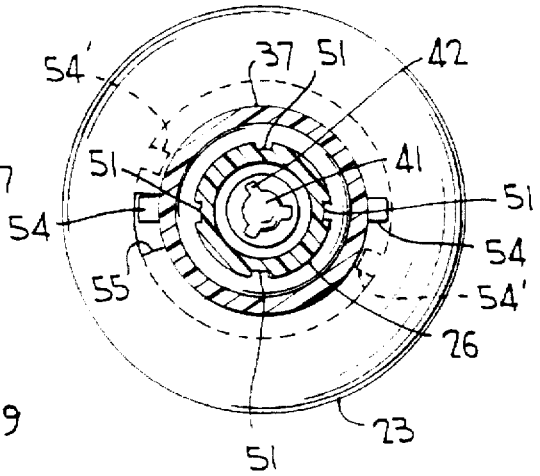
FIG. 4 is a view taken substantially along the line 4–4 of FIG. 1.

Skirt 37 has an external locking lug or lugs 54 which, as best seen in FIG. 4, when each are aligned with a cut out 55 provided in the crown of collar 23, extends through the cut out when the plunger is lowered into its position of FIG. 3. Some form of indicia (not shown) may be provided on the collar and/or the plunger head for aligning purposes. When in the FIG. 4 position, the plunger head is simply rotated slightly in either direction, as shown in phantom outline at 54' to lock down the plunger relative to the collar. In such position, seen in FIGS. 1, 2 and 3 a shoulder 58 at the upper end of seal member 45 sealingly engages a confronting shoulder 59 formed beneath the plunger head to avoid any leakage of product from the container via the vent ports, due to an increase in pressure within the container. Any such leakage is further avoided in the plunger lock-down position as seal 49 sealingly engages a smooth surface portion 60 of the stem located beyond the upper end of groove 51 as shown. And, any leakage of product from the container through discharge passage 38 and spout 35 via an unseated discharge valve 39 is prevented by the plugged sealing action between plug 33 and the lower end of the piston stem.

From the lock-down position of FIG. 3, the plunger head is simply rotated until lugs 54 are aligned with cut outs 55 whereupon the spring action of the return spring biases the piston outwardly of its bore to the FIG. 1 position as limited by limit stop 48.

From the foregoing it can be seen that a simple and economical yet highly effective pump dispenser has been devised for use in especially a wet environment without the tendency for shower water seeping into the container via the open container vent ports in any condition of the pump, even during pumping. The seal member, being a separate part from that of the collar, can be molded of a softer plastic such as polyethylene compared to the more durable collar of molded plastic such as polypropylene. The seal member seals the container vent closed during pumping through a predetermined length of the stem travel until the sealing action is interrupted upon the seal reaching the vent grooves shielded by a depending skirt of the plunger head. The shielding action substantially assures a moisture-free condition of the vent grooves during pumping in the wet environment to thereby avoid water flowing through the vent path into the container while the vent is open. And, water entrainment at the free end of the skirt, which can seep into the container to dilute the product, is avoided.

In the plunger lock-down position, the product in the container is sealed against leakage through the vent by the tight sealing engagement between the seal member and the underside of the head, and between the seal member and the upper end of the stem.

Obviously, many modifications and variations of the present invention are made possible in the light of the above teachings. For example, vent ribs rather than vent grooves could instead be provided, and the plunger can be locked into its fully depressed position by some equivalent means other than the lock lug disclosed, without departing from the scope of the invention. It is therefore to be understood that within the scope of the appended claims the invention may be practiced otherwise than as specifically described.

What is claimed is:

1. A manually operated liquid dispensing pump adapted to be mounted on a container of liquid to be dispensed, including a piston having a stem extending through a pump collar, the piston being reciprocable within a pump cylinder during a pumping operation to therewith define a variable volume pump chamber, said cylinder having a container vent port selectively venting the liquid in the container, said piston having a vent control means and a discharge valve for controlling a discharge of liquid from said chamber, a plunger head mounted on said stem having a discharge opening in communication with said valve, said head having a depending skirt surrounding an upper portion of said stem in spaced relation therewith, another portion of said stem being directly exposed to the atmosphere, the improvement wherein the pump includes liquid seal means mounted on said cylinder for sealing the vent port closed during the pumping operation to avoid ingress of a foreign liquid into the container via the vent port when using the pump in a wet environment, said seal means including an annular lip seal in sliding sealing engagement with said another portion of said stem; means on said upper portion of said stem substantially beneath said plunger head skirt for interrupting the sealing engagement at or near an end of each piston compression stroke to create vent passage means for opening the vent port, said interrupting means being maintained substantially moisture-free by said skirt when using the pump in the wet environment to avoid the ingress of said foreign liquid into the container in an open condition of the vent port.

2. The liquid dispensing pump according to claim 1, wherein said seal means is mounted on said cylinder by said collar, and said vent control means comprising said piston bearing against a shoulder stop formed on said seal means at an end of a piston return stroke.

3. The liquid dispensing pump according to claim 1, wherein said seal means further includes an annular seal flange in engagement with an upstanding mounting flange on said cylinder to which said collar is mounted.

4. The liquid dispensing pump according to claim 1, wherein said annular lip seal has a central opening through which said stem extends, and said depending skirt on said head surrounding said lip seal at the end of each piston compression stroke.

5. The liquid dispensing pump according to claim 4, wherein said skirt and said collar have lock means which interengage in a fully depressed position of said head.

6. The liquid dispensing pump according to claim 1, wherein said interrupting means comprises at least one longitudinal groove.

7. The liquid dispensing pump according to claim 6, wherein said groove is spaced from an upper end of said stem to present a smooth surface, said lip seal fluid tightly engaging said smooth surface in a plunger lock-down position in which said head is locked to said collar.

8. The liquid dispensing pump according to claim 1, wherein said annular lip seal has an external shoulder confronting a shoulder underneath said head and sealingly engaging the same in a plunger lock-down position in which said head is locked to said collar.

9. The liquid dispensing pump according to claim 8, wherein said shoulder underneath said head is located inwardly of a port located in said skirt for venting an annular chamber formed by said skirt and stem to avoid entrainment of liquid into said annular chamber when a free end of said skirt extends into an open annular groove form between said collar and said seal means.

10. The liquid dispensing pump according to claim 1, wherein said collar and seal means form an annular groove opening toward said head, said skirt defining an annular chamber with said stem, and a free end of said skirt extending into said annular groove during pumping, said skirt having at least one port for venting said annular chamber to atmosphere to avoid entrainment of liquid into said annular chamber when said free end extends into said annular groove.

* * * * *